United States Patent [19]

Sperling et al.

[11] 4,092,261

[45] May 30, 1978

[54] PROCESS FOR THE PRODUCTION OF POWDERY WASHING AND CLEANSING AGENT COMPOSITIONS

[75] Inventors: Gerhard Sperling; Dieter Jung; Klaus Hachmann, all of Hilden; Milan Johann Schwuger, Haan; Heinz Smolka, Langenfeld, all of Germany

[73] Assignee: Henkel Kommanditgesellschaft auf Aktien, Dusseldorf-Holthausen, Germany

[21] Appl. No.: 620,386

[22] Filed: Oct. 7, 1975

[30] Foreign Application Priority Data

Oct. 10, 1974 Austria ..... 8150/74

[51] Int. Cl.[2] ..... C02B 1/44; C11D 9/18; C11D 11/00; C11D 11/02

[52] U.S. Cl. ..... 252/131; 252/89 B; 252/140; 252/179; 423/329

[58] Field of Search ..... 252/89, 131, 140, 179; 423/329

[56] References Cited

U.S. PATENT DOCUMENTS

| | | | |
|---|---|---|---|
| 2,947,701 | 8/1960 | Ruff | 252/109 |
| 3,576,748 | 4/1971 | Petersson | 252/110 |
| 3,929,678 | 12/1975 | Laughlin | 252/526 |
| 3,962,116 | 6/1976 | Bloching | 252/301.21 |

FOREIGN PATENT DOCUMENTS

| | | | |
|---|---|---|---|
| 813,581 | 10/1974 | Belgium | 252/131 |
| 2,124,410 | 9/1972 | France | 252/110 |
| 2,422,655 | 11/1974 | Germany | 252/131 |
| 1,371,101 | 10/1974 | United Kingdom | 252/110 |

*Primary Examiner*—Dennis L. Albrecht
*Attorney, Agent, or Firm*—Hammond & Littell

[57] ABSTRACT

An improvement in the process for the production of powdery washing and cleansing agent compositions containing finely-divided water-insoluble silicate compounds, capable of binding calcium, soap, and, optionally, other surface-active compounds, builders and other customary detergent additives by spray-drying a slurry and recovering said powdery washing and cleansing agent composition which comprises separately spray-drying a slurry rich in said silicate compounds and combining the spray-dried powders with the remaining ingredients in powdery form; as well as the powdery washing and cleansing agents so produced.

8 Claims, No Drawings

PROCESS FOR THE PRODUCTION OF POWDERY WASHING AND CLEANSING AGENT COMPOSITIONS

THE PRIOR ART

As known, the detergents used in the household, in commercial establishments and in industry, frequently contain large quantities of condensed phosphates, particularly tripolyphosphates. These are provided to sequester the hardness formers of tap water and are responsible to a great extent for increasing the cleaning power of the capillary-active washing substances. The phosphorus content of these agents has been criticized by the public in connection with questions of the protection of the environment. The view is frequently expressed that the phosphates, which arrive in the rivers and lakes after treatment of the sewage, have great influence on the eutrophication of the waters, and is said to lead to an increase of the growth of algae and of oxygen consumption. It has therefore been tried to eliminate phosphate from the washing and cleaning processes or from the agents used for this purpose, or at least to substantially reduce its proportion.

Copending, commonly-assigned U.S. patent application Ser. No. 458,306, filed Apr. 5, 1974 now abandoned in favor of its continuation Ser. No. 800,308, filed May 25, 1977, and its continuation-in-part application Ser. No. 599,012, filed July 24, 1975 discloses a process for the washing, bleaching or cleaning of solid materials, particularly textiles, by treating these materials with a liquor containing compounds able to bind the cations that make water hard. The process is characterized in that finely-dispersed, water-insoluble silicate compounds having calcium-binding capacity of at least 50 mg CaO/gm of anhydrous active substance (AS) and having the formula I, combined water not shown $$(M_{2/n}O)_x \cdot Me_2O_3 \cdot (SiO_2)_y \qquad (I)$$

where M is a cation of the valence *n*, exchangeable with calcium, *x* is a number from 0.7 to 1.5, Me is aluminum or boron, and *y* is a number from 0.8 to 6, preferably from 1.3 to 4, are suspended in the aqueous treatment bath. The process of the patent makes possible the complete or partial replacement of phosphates that bind calcium ions by complexing and are still being used in the washing and cleaning process.

The calcium-binding capacity of the above-defined compounds may reach values of 200 mg CaO/gm AS and is preferably in the range of 100 to 200 mg CaO/gm AS. The above-defined compounds capable of binding calcium are referred to as "aluminosilicates" in the following text, for the sake of simplicity. This applies particularly to the sodium aluminosilicates that are to be used preferably. All data given for their preparation and processing apply accordingly to the totality of the above aluminosilicate compounds as defined in said earlier application.

The cation M employed is preferably sodium. However, the same can also be totally or partially replaced by other cations exchangeable with calcium, such as lithium, potassium, ammonium or magnesium, as well as by the cations of water-soluble organic bases, for example, by those of primary, secondary or tertiary alkylamines or alkylolamines with not more than 2 carbon atoms per alkyl radical, or not more than 3 carbon atoms per alkylol radical.

OBJECTS OF THE INVENTION

An object of the present invention is the development in the process for the production of powdery washing and cleansing agent compositions containing compounds capable of sequestering or binding calcium, including (A) from 5% to 50% by weight of at least one finely-divided, water-insoluble silicate compound containing at least some combined water and having a calcium binding power of at least 50 mg CaO/gm of anhydrous active substance and the formula on the anhydrous basis $$(M_{2/n}O)_x \cdot Me_2O_3 \cdot (SiO_2)_y$$

where M is a cation of the valence *n*, exchangeable with calcium, *x* is a number from 0.7 to 1.5, Me is a member selected from the group consisting of aluminum and boron, and *y* is a number from 0.8 to 6, surface-active compounds, including (B) from 2.5% to 10% by weight of at least one alkali metal soap, and optionally builders and other customary detergent additives comprising the steps of preparing an aqueous slurry of said ingredients, spray-drying said aqueous slurry and recovering said powdery washing and cleansing agent composition, the improvement consisting essentially of preparing a first aqueous slurry having only sufficient water content to be pumpable and containing at least 60% of component (A) spray-drying said first aqueous slurry and combining the spray-dried powdery product with the remainder of the ingredients of said washing and cleansing agent composition in powdery form including at least 60% of component (B).

Another object of the present invention is the obtaining of a powdery washing and cleansing composition by the above process.

These and other objects of the present invention will become more apparent as the description thereof proceeds.

DESCRIPTION OF THE INVENTION

The present invention relates to powdery, trickleable washing and cleansing agent compositions containing (A) at least one finely-divided, water-insoluble silicate compound containing at least some combined water and having a calcium binding power of at least 50 mg CaO/gm of anhydrous active substance and the formula on the anhydrous basis $$(M_{2/n}O)_x \cdot Me_2O_3 \cdot (SiO_2)_y$$

where M is a cation of the valence *n*, exchangeable with calcium, *x* is a number from 0.7 to 1.5, Me is a member selected from the group consisting of aluminum and boron, and *y* is a number from 0.8 to 6, preferably from 1.3 to 4, and B) soap, and also a content of surface-active compounds or tensides not belonging to (B), builders as well as additional components found in smaller quantities in washing and cleansing agent compositions, and which is characterized by the fact that the compositions consist of at least two powdered, individual products that are of different composition, the first of them being a product obtained by spray-drying an aqueous batch of part of the constituents of the final composition, this first product being rich in aluminosilicate but low in soap, based on the dry components, in comparison to the final composition of the complete substance to be prepared, while the other components of the final composition, present as the second or several additional powdery, individual products, are correspondingly low in aluminosilicate and rich in soap. Preferably at least 60% of the total amount of aluminosilicate is present in said first product and at least 60% of the total amount of soap is present in said second product.

The composition of the products according to the invention is generally within the range of the following recipe: 5 to 30% by weight of anionic and/or nonionic and/or zwitterionic, non-soap tensides and including therein from 2.2 to 10%, preferably from 2.5 to 10%, by weight of soap; 5% to 50% by weight of aluminosilicates; 15 to 90% by weight of complexing and/or non-complexing builders, as well as other adjuvants, if desired, present mainly in smaller amounts in such products; 0 to 40% by weight of bleaching components.

In addition, the invention concerns a process for the preparation of the products according to the invention, characterized by the fact that a slurry rich in component (A) but low in component (B), based on the dry constituents, and consisting of constituents of the final product, is spray-dried into a flowing powder and mixed with the remaining powdered components of the final product, which are correspondingly low in component (A) and rich in component (B). More particularly, the present invention relates to the development, in the process for the production of powdery washing and cleansing agent compositions containing compounds capable of sequestering or binding calcium, including A) from 5 to 50% by weight of at least one finely-divided, water-insoluble silicate compound containing at least some combined water and having a calcium binding power of at least 50 mg CaO/gm of anhydrous active substance and the formula on the anhydrous basis $$(M_{2/n}O)_x \cdot Me_2O_3 \cdot (SiO_2)_y$$

where M is a cation of the valence $n$, exchangeable with calcium, $x$ is a number from 0.7 to 1.5, Me is a member selected from the group consisting of aluminum and boron, and $y$ is a number from 0.8 to 6, surface-active compounds, including (B) from 2.5 to 10% by weight of at least one alkali metal soap, and optionally builders and other customary detergent additives comprising the steps of preparing an aqueous slurry of said ingredients, spray-drying said aqueous slurry and recovering said powdery washing and cleansing agent composition, the improvement consisting essentially of separately preparing a first aqueous slurry having only sufficient water content to be pumpable and containing at least 60% of component (A) and a second aqueous slurry having only sufficient water content to be pumpable and containing at least 60% of component (B), separately spray-drying said first aqueous slurry and said second aqueous slurry and combining the powdery products from said separate spray-drying steps.

When an aqueous slurry rich in component (A) is mentioned in the text, this means a slurry in which the proportion of component (A), based on the total weight of the dry components of this slurry, is greater than the proportion of the total component (A) in the dry constituents of the product to be prepared. Preferably the amount of component (A) in the aqueous slurry rich in component (A) is at least 60% of the total amount and most preferably from 75 to 100% of the total amount of component (A). Correspondingly, a slurry is low in component (B) when the proportion of component (B), based on the total weight of this slurry, is lower than the proportion of the total amount of component (B) in the total of the dry constituents of the product to be prepared. Corresponding explanations apply to the enrichment of the remaining constituents of the product to be prepared. The term "remaining constituents" includes all dry constituents of the product to be prepared, with the exception of the constituents of the spray-dried substance enriched with aluminosilicate. The remaining constituents that are, overall, low in aluminosilicate and rich in soap may, therefore, consist of several powdery, individual substances, where the soap content may be proportionately very high in one part of these individual substances, while it is present in smaller amounts, or not at all, in another of these powdery, individual substances.

Since substances according to the invention are prepared according to the process of the invention, all data given in the following text concerning the composition of the slurry rich in aluminosilicate also applies correspondingly to the composition of the spray-dried substance rich in aluminosilicate prepared from it and present in the products of the invention and vice versa.

The cation present in the aluminosilicates to be processed according to the invention is preferably sodium; however, it may be replaced by lithium, potassium, ammonium or magnesium, as well as by the cations of water-soluble organic bases, such as by those of primary, secondary or tertiary alkylamines or alkylolamines with not more than 2 carbon atoms per alkyl or not more than 3 carbon atoms per alkylol, respectively.

The above-defined aluminosilicates can be produced synthetically in a simple manner, for example, by reacting water-soluble silicates with water-soluble aluminates in the presence of water. To this end, aqueous solutions of the starting materials can be mixed with each other, or one component which is present in solid form can be reacted with another component which is present as an aqueous solution. The desired aluminosilicates can also be obtained by mixing both solid components in the presence of water, preferably with comminution of the mixture. Aluminosilicates can also be produced from $Al(OH)_3$, $Al_2O_3$ or $SiO_2$ by reaction with alkali metal silicate or alkali metal aluminate solutions, respectively. Finally, such substances are also formed from the melt, but this method seems of less economical interest because of the required high melting temperature and the necessity of transforming the melt into finely-dispersed products.

The cation-exchanging aluminosilicates to be used according to the invention are only formed if special precipitation conditions are maintained, otherwise products are formed which have no, or an inadequate, calcium exchanging power. The calcium exchanging power of at least 50 mg CaO/gm of anhydrous active substance (AS) is critical to the present process. If aluminosilicates are employed with below the critical limit of calcium exchanging power, very little, if any, soil removal from the soiled textiles is effected.

The aluminosilicates in aqueous suspension produced by precipitation or by transformation in finely-dispersed form according to other methods are obtained in an X-ray amorphous form. They can be transformed from the amorphous into the aged or crystalline state by heating the suspension in water to temperatures of 50° to 200° C. However, there is hardly any difference between these two forms as far as the calcium binding power is concerned. Aside from the drying conditions, the calcium binding power of the aluminosilicates is proportional to the amount of aluminum contained therein with reference to the amount of silicon. Nevertheless, the crystalline alumina silicates are preferred for the purpose of the invention. The preferred calcium binding power, which is in the range of 100 to 200 mg CaO/gm AS, is found primarily in compounds of the composition:

$$0.7 \text{ to } 1.1\ Na_2O \,.\, Al_2O_3 \,.\, 1.3 \text{ to } 3.3\ SiO_2$$

This summation formula comprises two types of different crystal structures (or their non-crystalline initial products) which also differ by their summation formulas. These are:

$$0.7 \text{ to } 1.1\ Na_2O \,.\, Al_2O_3 \,.\, 1.3 \text{ to } 2.4\ SiO_2 \qquad \text{(a)}$$

$$0.7 \text{ to } 1.1\ Na_2O \,.\, Al_2O_3 \,.\, > 2.4 \text{ to } 3.3\ SiO_2 \qquad \text{(b)}$$

The different crystal structures can be seen in the X-ray diffraction diagram. The d-values found are given in the examples in the description of the production of the aluminosilicates I and II.

The amorphous or crystalline aluminosilicate contained in the aqueous suspension can be separated by filtration from the remaining aqueous solution and be dried at temperatures of 50° to 400° C, for example. Depending on the drying conditions, the product contains more or less combined water. Anhydrous products are obtained by drying at 800° C. If it is desired to remove the water completely, this can be done by heating for 1 hour to 800° C. This is the way the AS contents of the aluminosilicates are also determined.

Such high drying temperatures are not recommended for the aluminosilicates to be used according to the invention, preferably the temperature should not exceed 400° C. It is of particular advantage that even products dried at substantially lower temperatures of 80° to 200° C, for example, until the adhering liquid water is removed, can be used for the purposes of the invention. The aluminosilicates thus produced, which contain varying amounts of combined water, are obtained after the disintegration of the dried filter cake, as fine powders whose primary particle size does not exceed 0.1 mm, but is mostly lower and ranges down to dust fineness, for example, to 0.1 $\mu$. It must be kept in mind that the primary particles can be agglomerated to larger structures. In some production methods primary particle sizes ranging from 30 to 1 $\mu$ are obtained.

Of particular advantage are aluminosilicates having at least 80% by weight of particles of 10 to 0.01 $\mu$, preferably 8 to 0.1 $\mu$. These aluminosilicates preferably contain no primary or secondary particles above 30 $\mu$. As far as the products are crystalline, they are "microcrystalline."

The formation of smaller particle sizes can already be enhanced by the precipitation conditions. For these smaller particle sizes, the intermixed aluminate and silicate solutions, which can also be introduced simultaneously into the reaction vessel, are subjected to great shearing forces. If crystalline aluminosilicates are produced, which are preferred according to the invention, the formation of larger or inter-penetrating crystals is prevented by slowly stirring the crystallizing mass.

Nevertheless, undesired agglomeration of crystal particles can occur during the drying, so that it is advisable to remove these secondary particles in a suitable manner, for example, by air sifting. Aluminosilicates obtained in coarser form, which are ground to the desired particle size, can also be used. Suitable for this purpose are, for example, mills and/or air sifters or combinations thereof. The latter are described, for example, in Ullmann, "Enzyklopaedie der technischen Chemie," vol. 1, 1951, p. 632 to 634.

A considerable improvement in the products, i.e., the washing result with the compounds used according to the invention, is achieved by the use of aluminosilicates with lower calcium binding capacity.

It is also advantageous for the purposes according to the invention to utilize products that are still moist immediately after their precipitation or even in suspension (without intermediate drying), such as (a) a still flowing suspension of aluminosilicate in the liquor in which it is present at the end of the process of preparation, (b) an aluminosilicate from which the mother liquor was partially removed, (c) a still flowing suspension of aluminosilicate in water, obtained after partial or complete rinsing out of the mother liquor, or (d) an aluminosilicate from which the rinse water was partially removed.

The data concerning the dried aluminosilicates, particularly also with respect to the calcium-complexing capability, apply accordingly in this case. The method by which the aluminosilicates still moist from precipitation are used is especially advantageous since it permits a considerable saving of energy for drying.

The washing and cleansing agent compositions according to the invention also contain alkali metal soaps. The soap content may vary widely, depending on their intended use. However, contents of approximately 2.2 to 10% by weight of soap are preferred in most presently popular textile detergents. The proportion of soap in the anhydrous constituents of the slurry for spray-drying is usually above 3% by weight, since not all components of the finished products are spray-dried.

The term "soap" is applied mainly to soaps of natural or synthetic, preferably saturated, higher fatty acids. These are mainly soaps of straight-chain fatty acids with 8 to 24 carbon atoms. Soaps not belonging to this group, such as soaps of rosin or naphthenic acids, may also be used, if desired. The cations may be those of alkali metals as well as other cations, such as those mentioned for component (A) above. Sodium soaps are preferred.

If the powdery product contains a content of a macromolecular organic soil suspension agent or agents, it is advantageous to treat these like soap. They should be added mainly to the remaining constituents of the slurries to be dried that are low in component (A). "Macromolecular organic soil suspension agents" are certain compounds that keep the soil, which was removed from the fibers, suspended in the washing liquor without redepositing on the fibers and thus prevent the graying of the textiles. Suitable as soil suspension agents in the sense of the invention are water-soluble colloids, mainly organic in nature, such as the salts of polymeric carboxylic acids, glue, gelatine, salts of ether carboxylic acids or ether sulfonic acids of starch or cellulose, particularly alkali metal salts of carboxymethyl cellulose, or salts of acid sulfuric acid esters of cellulose or starch. Also suitable are water-soluble polyamides containing acid groups. Soluble starch preparations and starch products other than those mentioned above, such as degraded starch and aldehyde starches, may be used. Polyvinyl pyrrolidone is also suitable.

The special advantage of the process according to the invention lies in the fact that it can be used to prepare trickleable washing and cleansing agent compositions characterized by excellent wetting characteristics. Furthermore, it has been observed that the process according to the invention requires less water for slurry suspension prior to spray-drying than the simultaneous slurry suspension prior to spray-drying of all components including components (A) and (B) in one slurry. This is due to the separation of the constituents into at least one slurry rich aluminosilicate and low in soap and, another slurry high in soap and, optionally, soil suspension agents and low in aluminosilicate. The use of energy for removal of water in the spray-drying is thus reduced and the load in the drying apparatus may be increased correspondingly, if desired. The separation of components (A) and (B), as far as it is possible in the processes according to the invention, appears to be generally advantageous. The dividing of the components of the product to be prepared is carried out preferably in such a manner that the amount of aluminosilicate is considerably reduced in the remaining constituents rich in soap, in comparison to that of the finished product. The constituents rich in soap may contain no aluminosilicate at all, a condition which is preferable. It is advantageous when the proportion of soap in the spray-drying product rich in aluminosilicate, based on the total weight of anhydrous soap, is at most 50%, optionally 40% and preferably only 33% of the total amount of soap present in the product to be prepared.

It is useful when the proportion of soap in the slurry rich in component (A) is not more than 2% of the total weight of the dry components of this batch. This proportion is generally below 1.5% and may be 0. However, it may be practicable not to exclude the soap completely from the slurry rich in component (A). On the contrary, it has been found that a small amount, that is above 0.2% and especially above 0.5%, by weight on a dry basis, of soap, particularly soaps of fatty acids with 12 to 18 carbon atoms, has a beneficial effect on the characteristics of the spray-dried product rich in component (A). For example, the stability of the particle size can be improved, the amount of dust can be reduced and/or the volume density can be reduced. Long-chained soaps, that is particularly soaps of fatty acids with 20 to 24 carbon atoms, are incorporated practically entirely in the mixture of the remaining constituents low in aluminosilicate.

The products prepared according to the invention should preferably contain at least one surface-active compound or tenside that is not a soap. Non-soap tensides are the tenside components that are not those of the component (B). It is well-known that they contain at least one hydrophobic, organic moiety in the molecule and one anionic, nonionic or zwitterionic group that facilitates water-solubility. In the non-soap tensides the carboxyl group is not the sole water-solubilizing group. The hydrophobic moiety is generally an aliphatic hydrocarbon radical with 8 to 26, preferably 10 to 22, and especially 12 to 18 carbon atoms, or an alkylaromatic radical, such as an alkylphenyl, with 6 to 18, preferably 8 to 16 carbon atoms in the alkyl.

Especially advantageous products prepared according to the process of the invention are those in which at least part of these tensides are nonionic surface-active compounds, or "nonionics." If the products to be prepared are to contain nonionics, these are preferably added to the slurry of the material rich in component (A). This means that the proportion of nonionics, based on the total amount of the dry constituents, is greater in the slurry rich in component (A) than in the remaining constituents for the product to be prepared, which are rich in soap. The nonionics may be added exclusively to the slurry rich in aluminosilicate. This is often desirable when anionic tensides that are not soaps are present in addition to the nonionics. While the anionic non-soap tensides may also be processed exclusively with the slurry rich in aluminosilicate, at least a portion of them is generally to be found among the remaining constituents. It has been observed that it is advantageous when the remaining constituents rich in soap contain on the basis of their total dry weight at least 1%, preferably 1.5% of a non-soap tenside. The non-soap tensides present in the remaining constituents of the product that are rich in soap, may be nonionics; however, they are preferably anionic tensides.

The slurry rich in component (A) or first slurry may contain additional conventional components of washing and cleansing agent compositions. These include particularly the neutral or alkaline detergent builders including those that can and those that cannot form complexes with calcium, among others. These compounds may be organic or inorganic. Further components like or unlike tensides and often present in minor amounts in washing and cleansing agent compositions may be contained in one of the slurries. These are, for example, foam stabilizers or inhibitors, textile fabric softeners, soil suspension agents, corrosion inhibitors, antimicrobial substances, etc. Compounds sensitive to heat and moisture are preferably not subjected to spray-drying; this applies especially to the bleach components, enzymes and perfumes.

The first slurry rich in aluminosilicate has a composition generally conforming to the following, based on the weight of the dry components: 5 to 95%, especially 8 to 60%, by weight of component (A) as well as at least one of the following constituents: Up to 35% by weight, preferably 5 to 25%, especially 5 to 18% by weight of nonionics, less than 2.5% by weight, preferably 0 to 2% and especially 0.2 to 1.5% by weight of soap, up to 75% by weight, preferably 10 to 60% by weight of other builders capable of binding or precipitating calcium, builders that are not capable of forming complexes with calcium and/or cationic, zwitterionic and/or anionic tensides that are not soaps, as well as additional components generally present in smaller amounts in washing and cleansing agent compositions.

The preparation of the slurry rich in aluminosilicate or first slurry may be accomplished in any manner, by mixing of its components. For example, an aqueous suspension of aluminosilicate can be mixed with the other components, one at a time.

The first slurry is then spray-dried by pumping it through jets to atomize the slurry into a stream of fine particles which are brought in contact with hot gases (approximately 200° to 300° C) in this form, so that the particles dry out. This is a process well-known to the industry. Spray-drying towers with jets installed in the upper part are preferable. The hot, drying gas is added either countercurrent or in the same direction to the atomized, aqueous slurry.

The composition of the powdery remaining constituents depends on the composition of the slurry rich in aluminosilicate, or the powdery component rich in aluminosilicate since the composition of the final product has been predetermined.

Suitable powdery products rich in soap may consist mainly of soap and water, for example. Such soap concentrates can be prepared by atomizing a slurry of mainly water and soap, where the addition of the previously mentioned additive tensides, especially anionic tensides, is advantageous. Also practical is the addition to the soap slurry of inorganic compounds such as sodium chloride or sodium hydroxide (such as an amount exceeding that required for the neutralization of the fatty acid). The same applies for the addition to the soap slurry of hydrotropic compounds such as the sodium salt of toluene sulfonic acid or cumene sulfonic acid.

The spray-dried product rich in aluminosilicate obtained is mixed with the remaining constituents of the product to be prepared, which are rich in soap. This may be accomplished while the portion rich in aluminosilicate is still warm, or later, after complete cooling. The remaining constituents can be combined with the powdery spray-dried portion rich in aluminosilicate in a single step of the process, or in several. For example, the spray-dried portion rich in aluminosilicate can be mixed in successive steps with a part of the remaining constituents of the product to be prepared that is especially rich in soap and with a bleaching component containing a bleaching compound and, if desired, activators and/or stabilizers for these. The remaining constituents that are overall, based on the total weight of all their components, low in aluminosilicate but rich in soap may be mixed partially or wholly in the form of a spray-dried product with the spray-dried portion rich in aluminosilicate. For example, two slurries may be used in the framework of the invention, one of which is rich in aluminosilicate and low in soap, the other rich in soap and low in aluminosilicate. Both slurries are converted into powdery products by spray-drying, and these are mixed together with each other as well as with remaining, other constituents of the final product, if desired. The preparation of the spray-dried products of differing compositions can be carried out in the same spray-drying installation with the use of two different sets of jets, or by preparing the products separately in turn, in the same installation. It is frequently advantageous to prepare powders of different compositions in different installations.

Among the useful anionic tensides are those of the sulfonate and sulfate type, such as the alkylbenzene sulfonates ($C_{9-15}$alkyl), the mixtures of alkenesulfonates, hydroxyalkanesulfonates, as well as alkanedisulfonates that can be obtained by sulfonation of olefins with subsequent hydrolysis, also alkane sulfonates as well as esters of $\alpha$-sulfo-fatty acids, such as $\alpha$-sulfo-fatty acids of methyl or ethyl esters of hydrogenated coconut, palm oil or tallow fatty acids. Additional suitable tensides are sulfuric acid monoesters of primary or secondary so-called Mazzoni-apparatus. This preparation is carried out in the following manner:

A melted, water-containing soap stream is fed at elevated temperature, for example, at 150° to 160° C, into spray nozzles and atomized into a vacuum chamber in the form of fine droplets. By virtue of the water evaporation which occurs in the vacuum chamber, a cooling effect and thus a solidification of the droplets into small solid spheres is produced. These spheres may, if desired, be isolated as such and employed in accordance with the present invention, or they may be scraped with the aid of a scraper from a wall against which they have been allowed to impinge, and can then be used in the form of fine flakes.

In addition, the soap concentrate may also be a soap powder which has been obtained by grinding soap in solid chunky form in a soap mill. This concentrate can be employed in good success in admixture with the spray-dried component (A).

Among the useful anionic tensides are those of the sulfonate and sulfate type, such as the alkylbenzene sulfonates ($C_{9-15}$alkyl), the mixtures of alkenesulfonates, hydroxyalkanesulfonates, as well as alkanedisulfonates that can be obtained by sulfonation of olefins with subsequent hydrolysis, also alkane sulfonates as well as esters of $\alpha$-sulfo-fatty acids, such as $\alpha$-sulfo-fatty acids of methyl or ethyl esters of hydrogenated coconut, palm oil or tallow fatty acids. Additional suitable tensides are sulfuric acid monoesters of primary or secondary alcohols (e.g., those from coconut fatty alcohols, tallow fatty alcohols or oleyl alcohol) or the secondary alcohols that can be obtained by the oxidation of paraffins as well as of adducts of 1 to 5 mols of ethylene oxide with the mentioned alcohols. The anionic tensides may be in the form of their alkali metal salts such as the sodium or potassium salts, or their ammonium salts as well as soluble salts of organic bases, such as mono-, di-, or trialkylamine and alkylolamines having from 1 to 2 carbons in the alkyl and 2 to 3 carbons in the alkylol, such as the salts of mono-, di- or triethanolamine.

Suitable nonionic surface-active compounds or tensides are adducts of up to 40, preferably 4 to 20 mols of ethylene oxide to 1 mol of a fatty alcohol, alkylphenol or fatty acid. Especially important are the adducts of 1 to 16 mols of ethylene oxide to coconut or tallow fatty alcohols, to oleyl alcohol or to secondary alkanols with 8 to 18, preferably 12 to 18 carbon atoms, as well as with monoalkylphenols or dialkylphenols with 6 to 14 carbon atoms in the alkyls. Polyglycol ethers that are insoluble or partially soluble in water and contain 1 to 4 ethylene glycol ether radicals in the molecule are also of interest in addition to the above water-soluble nonionics, especially when they are used in combination with water-soluble, nonionic or anionic tensides.

Also suitable are nonionic tensides of the type of the amine oxides or sulfoxides.

The zwitterionic tensides are compounds of the carboxybetaine or sulfobetaine type.

Suitable builders are compounds capable of complexing calcium as well as those that do not possess this characteristic. In the latter group are the wash alkali, which are the alkali metal bicarbonates, carbonates, borates or silicates as well as the alkali metal sulfates, and the alkali metal salts of organic sulfonic, carboxylic and sulfocarboxylic acids having from 1 to 8 carbon atoms, which do not possess any capillary activity. As examples of these are the water-soluble alkali metal salts of benzenesulfonic acid, toluene sulfonic acid or xylene sulfonic acid as well as the same salts of sulfoacetic acid, sulfobenzoic acid or of sulfobenzenedicarboxylic acids. Suitable as complexing builders are sodium tripolyphosphate as well as a large number of well-known organic complexing agents of the polycarboxylic acid type, including the polymeric carboxylic acids, aminocarboxylic acids, polyphosphoric acids, phosphonocarboxylic acids, hydroxycarboxylic acids, carboxyalkyl ethers, etc. Individual examples are nitrilotriacetic acid, citric acid and products of the pyrolysis of citric acid, optionally reacted with bisulfite, mellitic acid, O-carboxymethyl-tartronic acid, oxadisuccinic acid, O-carboxymethyl-hydroxysuccinic acid, cyclopentane-tetracarboxylic acid, polyacrylic acid, 1-hydroxyethane-1, 1-diphosphonic acid, copolymerizates of maleic acid and vinylmethyl ether in a 1:1 ratio; as well as their water-soluble salts exchangeable with calcium.

The following specific embodiments are illustrative of the invention without being limitative in any respect.

EXAMPLES

First, the production of the finished aluminosilicates is described, for which no invention is claimed. Other aluminosilicates useful in the invention are described in the first filed application Ser. No. 458,306.

PROCESS CONDITIONS

The aluminate solution, diluted with deionized water was mixed in a vessel of 15 liter capacity, under vigorous stirring with the silicate solution. Both solutions were at room temperature. An X-ray amorphous sodium aluminosilicate was formed in the exothermic reaction as a primary precipitation product. After stirring for 10 minutes, the suspension of the precipitation product was either separated as an amorphous product or transferred to a crystallization vessel where it remained for some time at the elevated temperature given to crystallize. After draining off the liquor from the crystals and washing with deionized water until the outflowing wash water had a pH-value of about 10, the filter residue was dried. When there is any deviation from this general production procedure, this is mentioned explicitly in the specific part. Thus, for example, in some cases for the practical tests, the homogenized uncrystallized suspension of the precipitation product or the crystal sludge was used. The water content was determined by heating the product for one hour to 800° C.

In the production of microcrystalline aluminosilicates, indicated by the suffix "*m*," the aluminate solution diluted with deionized water was mixed with the silicate solution and mixed in a high-speed intensive stirrer (10,000 rpm, "Ultraturrax," made by Janke & Kunkel IKA-Werk, Stauffen/Breisgau/Federal Republic of Germany). After vigorous stirring for 10 minutes; the suspension of the amorphous precipitation product was transferred to a crystallization vessel where the formation of large crystals was prevented by stirring the suspension. After draining off the liquor and washing with deionized water until the outflowing water had a pH value of about 10, the filter residue was dried, then ground in a ball mill and separated in a centrifugal sifter ("Microplex" air sifter, made by Alpine, Augsburg, Federal Republic of Germany) into two fractions, of which the finer fraction contained no portions above 10 $\mu$. The particle size distribution was determined by means of a sedimentation scale.

The degree of crystallization of an aluminosilicate can be determined from the intensity of the interference lines of an X-ray diffraction diagram of the respective product, compared to the corresponding diagrams of X-ray amorphous or fully crystallized products.

All data in % are in percent by weight.

The calcium binding power of the aluminosilicates or borosilicates was determined in the following manner. 1 liter of an aqueous solution, containing 0.594 gm of $CaCl_2$ (= 300 mg CaO/l = 30°dH) and adjusted to a pH of 10 with diluted NaOH, was mixed with 1 gm of the aluminosilicate or borosilicate (on the anhydrous basis, AS). Then the suspension was stirred vigorously for 15 minutes at a temperature of 22° C (+ 2° C). After filtering off the aluminosilicate, the residual hardness $x$ of the filtrate was determined. From it, the calcium binding power was calculated in mg CaO/gm. As according to the formula:

$$(30 - x) \cdot 10$$

If calcium binding power is determined at higher temperature, for example, at 60° C, better values are obtained than at 22° C. This fact distinguishes the aluminosilicates from most of the soluble sequestering agents that have been suggested so far for use in detergents and represents a particular technical progress in their use.

| Production conditions for aluminosilicate I: | |
|---|---|
| Precipitation: | 2.985 kg of an aluminate solution of the composition: 17.7% $Na_2O$, 15.8% $Al_2O_3$, 66.6% $H_2O$<br>0.15 kg of sodium hydroxide<br>9.420 kg of water<br>2.445 kg of a 25.8% sodium silicate solution of the composition 1 $Na_2O$ 6.0 $SiO_2$, prepared freshly from commercial waterglass and easily alkali-soluble silica |
| Crystallization: | 24 hours at 80° C |
| Drying: | 24 hours at 100° C |
| Composition: | 0.9 $Na_2O$ . 1 $Al_2O_3$ . 2.05 $SiO_2$ . 4.3 $H_2O$ (=21.6% $H_2O$) |
| Degree of crystallization: | Fully crystalline |
| Calcium binding power: | 150 mg CaO/gm AS. |

If the product obtained was dried for 1 hour at 400° C, an aluminum silicate Ia was obtained of the composition:

$$0.9\ Na_2O\ .\ 1\ Al_2O_3\ .\ 2.04\ SiO_2\ .\ 2.0\ H_2O\ (=\ 11.4\%\ H_2O)$$

which is likewise suitable for the purposes of the invention.

| Product conditions for aluminosilicate II: | |
|---|---|
| Precipitation: | 2.115 kg of an aluminate solution of the composition: 17.7% $Na_2O$ 15.8% $Al_2O_3$, 66.5% $H_2O$<br>0.585 kg of sodium hydroxide<br>9.615 kg of water<br>2.685 kg of a 25.8% sodium silicate solution of the composition: 1 $Na_2O$. 6 $SiO_2$ (prepared as under I) |
| Crystallization: | 24 hours at 80° C |
| Drying: | 24 hours at 100° C and 20 torr. |
| Composition: | 0.8 $Na_2O$. 1 $Al_2O_3$. 2.655 $SiO_2$. 5.2 $H_2O$ |
| Degree of crystallization: | Fully crystalline |
| Calcium binding power: | 120 mg CaO/gm AS. |

This product too can be dehydrated by drying (for 1 hour at 400° C) to the composition:

$$0.8\ Na_2O\ .\ 1\ Al_2O_3\ .\ 2.65\ SiO_2\ .\ 0.2\ H_2O$$

This dehydration product IIa is likewise suitable for the purposes of the invention.

The aluminosilicates I and II show in the x-ray diffraction diagram the following interference lines.

| d-values, recorded with Cu-$K_\alpha$- radiation in A | |
|---|---|
| I | II |
| — | 14.4 |
| 12.4 | — |
| — | 8.8 |
| 8.6 | — |
| 7.0 | — |
| — | 4.4(+) |

-continued

| d-values, recorded with Cu-$K_\alpha$- radiation in A I | II |
|---|---|
| 4.1 (+) | — |
| — | 3.8 (+) |
| 3.68 (+) | — |
| 3.38 (+) | — |
| 3.26 (+) | — |
| 2.96 (+) | — |
| — | 2.88 (+) |
| — | 2.79 (+) |
| 2.73 (+) | — |
| — | 2.66 (+) |
| 2.60 (+) | — |

It is quite possible that not all these interference lines will appear in the X-ray diffraction diagram, particularly if the aluminosilicates are not fully crystallized. For this reason, the d-values which are the most important for the characterization of these types are identified by a "(+)."

| Production conditions for aluminosilicate Im (microcrystalline production) | |
|---|---|
| Precipitation: | 2.985 kg of an aluminate solution of the composition 17.7% $Na_2O$, 15.8% $Al_2O_3$, 66.6% $H_2O$<br>0.150 kg of sodium hydroxide<br>9.420 kg of water<br>2.445 kg of a 25.8% sodium silicate solution of the composition: 1 $Na_2O$. 6 $SiO_2$ (prepared as in I) |
| Crystallization: | 6 hours at 90° C |
| Drying: | 24 hours at 100° C |
| Composition: | 0.9 $Na_2O$ . 1 $Al_2O_3$ . 2.04 $SiO_2$ . 4.3 $H_2O$ (=21.6% $H_2O$) |
| Degree of Crystallization: | Completely crystalline |
| Calcium binding power : | 170 mg CaO/gm AS. |

The distribution of the particle size determined by sedimentation analysis was in the following range:

| | |
|---|---|
| > 40 $\mu$ = 0%<br>> 10 $\mu$ = 85% to 95%<br>< 8 $\mu$ = 50% to 85% | The maximum range of the particle size distribution curve was situated at 3 to 6 $\mu$. |

The degree of crystallization of an aluminosilicate can be determined from the intensity of the interference lines of an X-ray diffraction diagram of each product in comparison with the respective diagrams of amorphous or completely crystallized products.

The salt constituents contained in the detergents of the examples, such as surfactants in salt form, other organic salts, as well as inorganic salts, were present as sodium salt, unless explicitly stated otherwise. This also applies to the precipitation inhibitors or chelating agents which are designated for simplicity's sake as the corresponding acids. The designations and abbreviations used have the following meaning:

ABS — the salt of alkylbenzenesulfonic acid with 10 to 15, preferably 11 to 13 carbon atoms in the alkyl chain, obtained by condensation of straight-chain olefins with benzene and sulfonation of the alkylbenzene thus obtained.

Soap — the sodium salt of a mixture of equal parts by weight of hardened tallow and rapeseed fatty acids.

TA + $x$ EO — the addition products of ethylene oxide (EO) to tallow fatty alcohol (TA) (iodine number 0.5), where the values for $x$ indicate the molar amount of ethylene oxide added to 1 mol of alcohol.

Perborate — a technical grade product of the approximate composition $NaBO_2 . H_2O_2 . 3H_2O$.

NTA — the salt of nitrilotriacetic acid.

CMC — the salt of carboxymethyl cellulose.

| Spray-dried powder | I | II |
|---|---|---|
| Aluminosilicate Im | 27.8% | 29.0% |
| Sodium tripolyphosphate | 28.8% | 29.4% |
| ABS | 8.3% | — |
| Soap | 4.9% | 5.1% |
| TA + 14 EO + TA + 5 EO (3:1) | 6.6% | 10.15% |
| $MgSiO_3$ | 3.2% | 3.6% |
| Sodium silicate $SiO_2 : Na_2O = 3.35$ | 4.2% | 4.35% |
| CMC | 2.5% | 2.6% |
| NTA | 0.278% | 0.29% |
| Brightener | 0.361% | 0.377% |
| $Na_2SO_4$ and Water | Balance | Balance |

were prepared by mixing the aluminosilicate with the nonionic tensides and half of each of the sodium silicate and magnesium silicate, and, in the case of composition I, of all of the ABS, to form an aqueous mixture containing approximately 48% by weight of dry constituents. The remaining constituents were combined into a second aqueous mixture with a content of 52% by weight of dry ingredients. Each slurry was spray-dried separately by pumping each through the spray-jets attached at the upper end of the spray-drying tower. There they were divided into a stream of fine particles and dried in a heated air current (260° C).

The addition of 0.4% by weight of soap prepared from hardened tallow fatty acid, based on the total composition, or approximately 1.2% by weight of the dry constituents of the slurry rich in aluminosilicate, improved further the powder characteristics of the spray-dried product rich in aluminosilicate. In the case of composition II, the spray-dried product rich in soap became more wettable by the addition of 2% by weight of ABS, based on the total weight of the dry constituents of the slurry rich in soap.

The spray-dried product rich in aluminosilicate was mixed with the spray-dried product rich in soap, to form the finished cleansing agent. The further addition of substances sensitive to heat and moisture, such as perborates, is possible at this point.

A product very similar to composition II was prepared by combining all components listed in composition II, with the exception of the soap, to form a slurry with a content of 58% by weight of dry constituents. This slurry was converted into a trickleable, powdery product by spray-drying. This product was then mixed with the stipulated amount of soap, which had been prepared as follows to yield a spray-dried product:

A slurry of 60% by weight of soap, 2% by weight of the sodium salt of toluene sulfonic acid and 38% by weight of water was heated to approximately 90° C and then atomized through fine jets into a chamber or approximately the same temperature, with circulating air. The obtained cooled, powdery soap concentrate had a content of approximately 66% of soap and 2.2% of toluene sulfonate (the rest was water and small amounts of salts introduced with the soap and the sodium toluene sulfonate).

The product has excellent wetting characteristics. It differs in composition from the product of composition II only with respect to the addition of the small amount of toluene sulfonate.

The preceding specific embodiments illustrate the practice of the invention. It is to be understood hownat other expedients known to those skilled in the disclosed herein, may be employed without de- g from the spirit of the invention or the scope of pended claims.

claim:

n a process for the production of powdery wash- nd cleansing agent compositions containing com- ds capable of sequestering or binding calcium, said positions consisting of (A) from 5 to 50% by weight least one finely-divided, water-insoluble silicate pound having a calcium binding power of 50 to 200 CaO/gm of anhydrous active substance, a particle of from 0.01 μ to 30 μ and the formula on the anhy- s basis $$(Na_2O)_x \cdot Al_2O_3 \cdot (SiO_2)_y$$

rein $x$ is a member from 0.7 to 1.1 and $y$ is a number n 1.3 to 3.3, (B) from 5 to 25% by weight of nonionic face-active compounds, (C) from 2.5 to 10% by ight of at least one alkali metal soap, at least some of ich are soaps of fatty acids with 20 to 24 carbon ms, and (D) from 15 to 60% by weight of at least one nventional ingredient of washing and cleansing com- sitions as follows: macromolecular organic soil-sus- nsion agents, anionic surface-active compounds of e sulfonate and sulfate type, zwitterionic surface-ac- ve compounds, wash alkalis, sodium tripolyphosphate, ganic builder salts capable of binding or precipitating lcium, foam stabilizers, non-soap foam inhibitors, xtile fabric softeners, antimicrobial agents, optical righteners, bleaching components, enzymes, perfumes nd water, comprising the steps of preparing an aqueous lurry of said ingredients of said composition except hose compounds sensitive to heat and moisture, spray- lrying said aqueous slurry and recovering said pow- dery washing and cleansing composition, the improve- ment consisting essentially of preparing a first aqueous slurry having only sufficient water content to be pump- able and containing from 75 to 100% of the total amount of component (A), from 50 to 100% of the total amount of component (B), from 0.2 to 2% of compo- nent (C), where said alkali metal soap is an alkali metal salt of a fatty acid with 12 to 18 carbon atoms, and from 10 to 60% based on the weight of the dry components of said first aqueous slurry of component (D) except for said macromolecular organic soil suspension agents, and those compounds sensitive to heat and moisture, spray-drying said first aqueous slurry and combining the spray-dried powdery product with the remainder of said ingredients in powdery form, with the proviso that at least 60% of component (C) including all of said soaps of fatty acids with 20 to 24 carbon atoms is in said remainder of said ingredients in powdery form.

2. The process of claim 1 wherein all of said silicate compound is in said first aqueous slurry.

3. The process of claim 1 wherein said soap of an alkali metal salt of a fatty acid with 12 to 18 carbon atoms is present in said first slurry in an amount of from 0.5 to 1.5% by weight of the weight of the dry constitu- ents of said first slurry.

4. The process of claim 1 wherein said nonionic sur- face-active compounds are incorporated in said first slurry completely.

5. The process of claim 1 wherein said components (B) and (D) include surface-active compounds other than soaps in an amount of at least 1.5% by weight of the weight of the said powdery washing and cleansing agent composition which are incorporated in said sec- ond slurry.

6. The process of claim 1 wherein said silicate com- pounds are crystalline.

7. The process of claim 1 wherein said component (A) is present in an amount of from 27.8 to 29% by weight.

8. The powdery washing and cleansing agent compo- sitions produced by the process of claim 1.

* * * * *

UNITED STATES PATENT AND TRADEMARK OFFICE

CERTIFICATE OF CORRECTION

PATENT NO. : 4,092,261

DATED : May 30, 1978

INVENTOR(S) : GERHARD SPERLING; DIETER JUNG; KLAUS HACHMANN; MILAN JOHANN SCHWUGER; HEINZ SMOLKA

It is certified that error appears in the above-identified patent and that said Letters Patent are hereby corrected as shown below:

Column 5, line 4, "alumina" should be --alumino--.

Column 9, lines 45 to 54 + "ary" on line 55 to be deleted and the following inserted:

-- In place of the spray-dried soap concentrate with a soap content of about 100%, which has been prepared as described hereinbefore, it is readily possible to utilize with good success also concentrates with other soap concentrations, for example, with a soap content of 66% to 100% by weight. Alternatively, instead of the spray-dried product which was dried in a hot stream of air, a soap concentrate could also be used which was prepared with the aid of a--.

Column 11, line 67, "(+2°C)" should be --(±2°C)--.

Column 14, line 5, add --Powdery washing agents of the following compositions--.

Signed and Sealed this

*Twenty-ninth* Day of *September 1981*

[SEAL]

*Attest:*

GERALD J. MOSSINGHOFF

*Attesting Officer*

*Commissioner of Patents and Trademarks*